US006682467B2

(12) United States Patent
Zimmermann et al.

(10) Patent No.: US 6,682,467 B2
(45) Date of Patent: Jan. 27, 2004

(54) ELASTIC ROLL AND METHOD OF MAKING THE ROLL

(75) Inventors: Lothar Zimmermann, Krefeld (DE); Carsten Sohl, Fredericia (DK)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/953,199

(22) Filed: Sep. 17, 2001

(65) Prior Publication Data

US 2002/0045523 A1 Apr. 18, 2002

(30) Foreign Application Priority Data

Sep. 18, 2000 (DE) ..... 100 46 055

(51) Int. Cl.[7] ..... F16C 13/00; B21K 1/02

(52) U.S. Cl. ..... 492/50; 492/59; 29/895.211; 29/895.32

(58) Field of Search ..... 492/50, 30, 53, 492/54, 28, 56; 29/895.211, 895.32

(56) References Cited

U.S. PATENT DOCUMENTS

| | | | | |
|---|---|---|---|---|
| 4,321,033 A | * | 3/1982 | Eddy et al. | 462/60 |
| 4,466,164 A | | 8/1984 | Tadokoro et al. | 492/44 |
| 5,602,712 A | * | 2/1997 | Daifuku et al. | 492/53 |
| 5,740,008 A | * | 4/1998 | Maduda et al. | 361/225 |
| 5,810,705 A | * | 9/1998 | Mimura et al. | 492/56 |
| 5,895,711 A | * | 4/1999 | Yamaki et al. | 492/53 |
| 6,013,201 A | * | 1/2000 | Hayashida et al. | 492/59 |
| 6,073,548 A | | 6/2000 | Kayser et al. | 492/56 |
| 6,253,671 B1 | | 7/2001 | Kayser | 492/48 |
| 6,340,528 B1 | * | 1/2002 | Hsieh et al. | 492/53 |
| 6,419,615 B1 | * | 7/2002 | Chen et al. | 492/56 |
| 6,428,455 B1 | | 8/2002 | Sohl | 492/50 |
| 6,459,878 B1 | * | 10/2002 | Tomoyuki et al. | 492/56 |

FOREIGN PATENT DOCUMENTS

| | | |
|---|---|---|
| DE | 3703564 | 8/1987 |
| DE | 4226789 | 2/1994 |
| DE | 29722778 | 5/1998 |
| DE | 19710573 | 9/1998 |
| DE | 19758443 | 9/1998 |
| DE | 19807712 | 9/1999 |
| DE | 29880097 | 9/1999 |
| DE | 19851936 | 5/2000 |
| EP | 1 001 081 A2 * | 5/2000 |
| EP | 1048782 | 11/2000 |

* cited by examiner

*Primary Examiner*—Gregory Vidovich
*Assistant Examiner*—Marc Jimenez
(74) *Attorney, Agent, or Firm*—Greenblum & Bernstein, P.L.C.

(57) ABSTRACT

Roll for smoothing a web and method of making the roll, wherein the roll includes a hard roll core. An elastic covering layer is arranged on an outside surface of the hard roll core. The elastic covering layer includes an elastic matrix material and fibers embedded in the elastic matrix material. At least some of the fibers have a diameter which is less than 800 nm. A surface of the elastic covering layer has an extremely high smoothness. The method includes introducing the fibers into the elastic matrix material to form the elastic covering layer and coupling the elastic covering layer with the hard roll core.

43 Claims, 2 Drawing Sheets

PRIOR ART

ELASTIC ROLL AND METHOD OF MAKING THE ROLL

CROSS REFERENCE TO RELATED APPLICATIONS

The present application claims priority under 35 U.S.C. §119 of German Patent Application No. 100 46 0550.0 filed on Sep. 18, 2000, the diclosure of which is expressly incorporated by reference herein in its entirety.

BACKGROUND OF THE INVENTION

1. Field of the Invention

The present invention relates to a roll, in particular a roll for the smoothing of paper webs. The roll has a hard roll core made of, in particular, metal and is provided on its outside with an elastic covering layer which includes an elastic matrix material and fibers embedded into the matrix material. The invention is further directed to a method for the manufacture of such a roll.

2. Discussion of Background Information

Elastic rolls of this kind are used, for example, in the satining of paper webs. Here, one elastic roll forms, in each case together with a hard roll, a press gap through which the paper web to be treated is guided. The hard roll has a very smooth surface consisting, for example, of steel or chilled cast iron and is responsible for the smoothing of that side of the paper web facing it. The elastic roll acting on the opposite side of the paper web effects a homogenizing and compacting of the paper web in the nip. The order of magnitude of the rolls ranges from lengths of 3 m to 12 m and diameters from 450 to 1500 mm. They can withstand line forces of up to 600 N/mm and compressive stresses of up to 130 N/mm$^2$.

To achieve a smoothing on both sides of the paper web, normally a plurality of roll pairs of this kind are successively disposed in a calender, with each of the two sides of the paper web alternately coming into contact now with the hard metal roll and now with the elastic roll in successive gaps. Since the surface of the elastic roll has a relatively high roughness with respect to the extremely smooth surface of the hard roll, the previously achieved smoothing result is at least partly again ruined in each case at the side of the paper web which is being guided over the elastic roll in the current smoothing gap.

A further problem lies in the fact that the required multi-roll calenders are expensive and the transport speed of the paper web is limited when multi-roll calenders are used. This is particularly disadvantageous since the trend in paper manufacturing is towards carrying out satining in an online operation. The paper web exiting the paper making machine or coating machine is here guided directly through the paper smoothing apparatus (e.g., a calender), whereby higher demands than previously are made on the rolls of the smoothing apparatus, particularly with respect to temperature resistance. As a result of the high transportation speeds of the paper web required in online operation and the high rotation speeds of the calender rolls associated with this, their nip frequency, that is the frequency with which the covering is compressed and relieved of its load again, is increased, which in turn leads to increased roll temperatures. These high temperatures arising in online operation result in problems which can even result in the destruction of the plastic coatings in known elastic rolls. On the one hand, with known plastic coatings, maximum temperature differences of around 20° C. are permissible over the width of the roll and, on the other hand, the plastics conventionally used for the coating have a substantially higher coefficient of thermal expansion than the conventionally used steel rolls or chilled cast-iron rolls so that high axial stresses occur between the steel roll or the chilled cast-iron roll and the plastic coating connected to it due to an increase in temperature.

So-called hot spots, at which a peeling or even a breaking open of the plastic layer occurs, can arise due to these high stresses in conjunction with hot regions occurring particularly in spot form.

These hot spots occur in particular when, in addition to the mechanical stresses and the relatively high temperature, crystallization spots are present in the form of, for example, defective adhesive bonds, deposits or above-average recesses in the elastic coating, for example due to creases or foreign bodies in the paper web. In these cases, the temperature at the crystallization spots can increase from the normal 80° C. to 90° C. to more than 150° C., whereby the above-mentioned destruction of the plastic layer occurs.

To control the properties of the elastic covering layer, fillers are normally introduced into the matrix material in the form of fibers or powder. Depending on the quantity and physical property of these fillers, the physical properties of the elastic covering layer are dominated or influenced by the fillers. For example, the thermal conductivity of the elastic covering layer can be improved by using fillers having a high thermal conductivity.

The smoothness of the surface of the covering layer is normally achieved by an appropriate grinding and polishing of the covering layer. Due to the size of the normally used fillers, however, only a listed smoothness of the surface of the covering layer can be achieved. For example, fibers previously used as a filler typically have diameters between 8 $\mu$m up to 20 $\mu$m. Since these fillers come to lie at the surface in the grinding of the surface, and exit this in part, the smoothness of the surface of known elastic rolls is substantially lower than the smoothness of the known hard rolls.

SUMMARY OF THE INVENTION

The present invention provides for an elastic roll of the kind initially mentioned, and a method for the manufacture of such a roll, with which the result in the smoothing procedure is further improved with respect to conventional elastic rolls and the risk of the occurrence of hot spots is reduced.

Starting from a roll of the kind initially mentioned, the invention provides that the diameter of the fibers is less than 800 nm so that the surface of the elastic covering layer has an extremely high smoothness, in particular an Ra value of less than around 0.6 $\mu$m, in that the thickness of the elastic covering layer amounts to between 3 and 20 mm and in that, in addition to the fibers, powdery fillers are embedded in the matrix material whose outer dimensions are in each case less than 1 $\mu$m at least in one direction.

A corresponding method is characterized in that, to produce an extremely high smoothness of the elastic covering layer, in particular an Ra value of less than around 0.6 $\mu$m, substantially only fibers are introduced into the elastic matrix material whose diameters are less than 800 nm, in that, in addition to the fibers, powdery fillers are introduced into the matrix material whose outer dimensions are in each case less than 1 $\mu$m at least in one direction and in that the elastic covering layer is formed with a thickness of between 3 and 20 mm.

In a roll of the invention, exclusively fibers and powdery fillers (both generally termed fillers in the following) having dimensions which are many times smaller than the dimensions of conventional fillers are thus used. A plurality of advantages are achieved thereby. On the one hand, the surface of the elastic covering layer including these extremely small fillers is substantially smoother than the surface of conventional elastic rolls after the grinding and polishing since the filler sections projecting out of the surface have correspondingly small dimensions.

On the other hand, due to the small dimensions of the fillers, a substantially finer distribution of the fillers within the covering layer is possible, whereby both a better thermal conductivity and a higher strength of the covering layer is achieved. The improved thermal conductivity results in the high temperatures occurring in operation, in particular at defective locations, being dissipated very quickly so that the occurrence of hot spots is largely prevented. The higher strength which is achieved by the better homogeneity of the covering layer material also here results in a reduction in the probability of hot spots occurring.

The improved thermal conductivity is reached in particular in that a higher packing density of the fillers can be reached due to the reduced dimensions of the fillers. With this increased packing density, the quantity of the matrix material present between the fillers and normally having a low thermal conductivity is reduced so that the overall thermal conductivity of the elastic covering layer is improved. The powdery fillers arranged in these free matrix regions formed between the fibers furthermore have the effect that these regions also have an increased thermal conductivity, whereby the extremely high smoothness of the covering layer is maintained due to the selected dimensions of the powdery fillers.

Furthermore, the number of the required smoothing gaps can be reduced due to the improved surface smoothness since a high smoothness of the paper web can also be achieved at the side of the paper web associated with the elastic roll and the smoothing result previously achieved by the hard roll is not again degraded by the elastic roll as with the known rolls.

In accordance with a further advantageous embodiment of the invention, the diameter of the fibers is less than around 500 nm, in particular less than around 200 nm. The smaller the diameters of the fibers are selected, the smoother the surface of the covering layer is and, associated therewith, the better the smoothing result is. This also applies with respect to the powdery fillers so that the outer dimensions of the powdery fillers are preferably less than 800 nm at least in one direction, in particular less than around 500 nm, preferably less than around 200 nm.

The fibers are preferably formed as carbon fibers, aramide fibers or glass fibers. A mixture of these fibers is also possible. The powdery fillers are preferably made of the same material as the fibers, but can basically also consist of different materials with a high thermal conductivity. The fibers can advantageously be mutually connected, for example twisted or knitted, and advantageously be present in the form of fiber rovings or of a fiber fleece. An improved thermal conductivity with respect to conventional covering layers is achieved due to the connection of the fibers with a length, for example, of around 10 mm or also less in conjunction with the increased pacing density.

Predominantly the diameter of the fibers is decisive for the desired surface smoothness when one of the ends of the largest proportion of the fibers projects from the surface of the covering layer during grinding. The smaller the diameter of the fibers, the higher the surface smoothness of the covering layer thus is after grinding and polishing. If the fibers predominantly lie at the surface of the covering layer with their longitudinal sides, then the surface smoothness is likewise improved with respect to conventional covering layers due to the reduced thickness, even if the length of the fibers is selected as normally. The use of carbon fibers is advantageous in that these have a good thermal conductivity. A fast heat dissipation via the carbon fibers is ensured in this manner when the roll heats up in operation.

The same applies in analogous manner for the powdery fillers. In particular with a formation as essentially round or spherical particles, their diameter is less than 1 $\mu$m.

The fillers can preferably be uniformly distributed in the matrix material, with a very homogeneous mixture and, associated therewith, a very high strength of the covering layer being achieved due to the low size of the fillers with a simultaneously very good thermal conductivity. The improved thermal conductivity is in particular achieved in that the material of the fillers is selected such that it has a higher thermal conductivity than the matrix material.

In accordance with a further advantageous embodiment of the invention, the surface of the elastic covering layer has an Ra value of less than around 0.5 $\mu$m, in particular of less than around 0.2 $\mu$m, preferably of less than around 0.1 $\mu$m. The elastic roll thus has a surface smoothness which lies in the order of magnitude of the surface smoothness of the hard roll so that on running through a smoothing gap both sides of the paper web are essentially smoothed with the same quality. Depending on the desired result, some or almost all of the smoothing gaps of a multi-roll calender can thus be omitted so that in the ideal case a sufficient smoothing result is achieved with a single smoothing gap.

The manufacture of the elastic roll can take place in a known manner, for example, by an injection, casting or winding method onto the roll core, with—in accordance with the invention—extremely small powdery fillers and extremely thin fibers being introduced into the elastic matrix material or being coated therewith in a winding method. The fibers can preferably be present in the form of fiber rovings so that extremely thin layers of fiber rovings can be wound onto the roll core in accordance with the extremely thin diameter of the fibers. The rovings are preferably impregnated with the matrix material before or during the winding or treated with the matrix material after the winding onto the roll core. The use of a fiber fleece which ensures a good thermal conductivity and which can be impregnated with the matrix material in the same way is also advantageous.

The invention provides for a roll for smoothing a web comprising a hard roll core. An elastic covering layer is arranged on an outside surface of the hard roll core. The elastic covering layer comprises an elastic matrix material and fibers embedded in the elastic matrix material. At least some of the fibers comprise a diameter which is less than 800 nm. A surface of the elastic covering layer has an extremely high smoothness.

The extremely high smoothness may be defined by an Ra value of less than around 0.6 $\mu$m. The elastic covering layer may comprise a thickness of between 3 and 20 mm. The roll may further comprise powdery fillers embedded in the elastic matrix material. At least some of the powdery fillers may comprise an outer dimension which is less than 1 $\mu$m at least in one direction. The web may comprise a paper web. The hard roll core may comprise a metal. The metal may comprise one of steel and chilled cast iron. The diameter may be less than around 500 nm. Alternatively, the diameter may also be less than around 200 nm. The roll may further comprise powdery fillers embedded in the elastic matrix material, wherein at least one outer dimension of the powdery fillers is smaller than around 1 μm. At least one outer dimension of the powdery fillers may be smaller than around 800 nm or than around 500 nm. At least one outer dimension of the powdery fillers may be smaller than around 200 nm. The powdery fillers may be smaller than 1 μm. The powdery fillers may be smaller than around 800 nm. The powdery fillers may also be smaller than around 500 nm. Furthermore, the powdery fillers may be smaller than around 200 nm. At least some of the powdery fillers may comprise one of substantially round particles and spherical particles. At least some of the powdery fillers may comprise carbon. At least some of the fibers may comprise carbon fibers. The powdery fillers may comprise a material that has a higher thermal conductivity than that of the elastic matrix material. The fibers may comprise a material that has a higher thermal conductivity than that of the elastic matrix material. The powdery fillers may be uniformly distributed in the elastic matrix material.

The fibers may be uniformly distributed in the elastic matrix material. The surface of the elastic covering layer may have an Ra value of less than around 0.5 μm. The surface of the elastic covering layer may also have an Ra value of less than around 0.2 μm. Furthermore, the surface of the elastic covering layer may have an Ra value of less than around 0.1 μm.

The invention also provides for a method of making a roll for smoothing a web which includes a hard roll core, an elastic covering layer arranged on an outside surface of the hard roll core, the elastic covering layer comprising an elastic matrix material and fibers embedded in the elastic matrix material, and at least some of the fibers comprising a diameter which is less than 800 nm, the method comprising introducing the fibers into the elastic matrix material to form the elastic covering layer, and coupling the elastic covering layer with the hard roll core, wherein a surface of the elastic covering layer has an extremely high smoothness.

The method may further comprise forming the surface of the elastic covering layer with an Ra value of less than around 0.6 μm. The method may further comprise introducing powdery fillers into the elastic matrix material. At least some of the powdery fillers may comprise at least one outer dimension which is smaller than 1 μm. The method may further comprise forming the elastic covering layer with a thickness of between 3 and 20 mm. The method may further comprise forming the elastic covering layer on the hard roll core by one of an injection method, a casting method and a winding method. The method may further comprise forming the elastic covering layer on the hard roll core by one of an injection method, a casting method and a winding method. The method may further comprise applying the fibers and the elastic matrix material onto the hard roll core. The method may further comprise applying the fibers, the powdery fillers, and the elastic matrix material onto the hard roll core.

The invention also provides for a roll for smoothing a web comprising a hard roll core. An elastic covering layer is arranged on an outside surface of the hard roll core. The elastic covering layer comprises an elastic matrix material and each of fibers and fillers embedded in the elastic matrix material. At least some of the fibers comprise a diameter which is less than 800 nm. At least some of the fillers comprise at least one outer dimension which is less than 1 μm. A surface of the elastic covering layer has an Ra value of less than around 0.6 μm.

BRIEF DESCRIPTION OF THE DRAWINGS

The invention is described in more detail in the following by means of embodiments with reference to the drawings, in which.

DETAILED DESCRIPTION OF THE INVENTION

Figure 1:
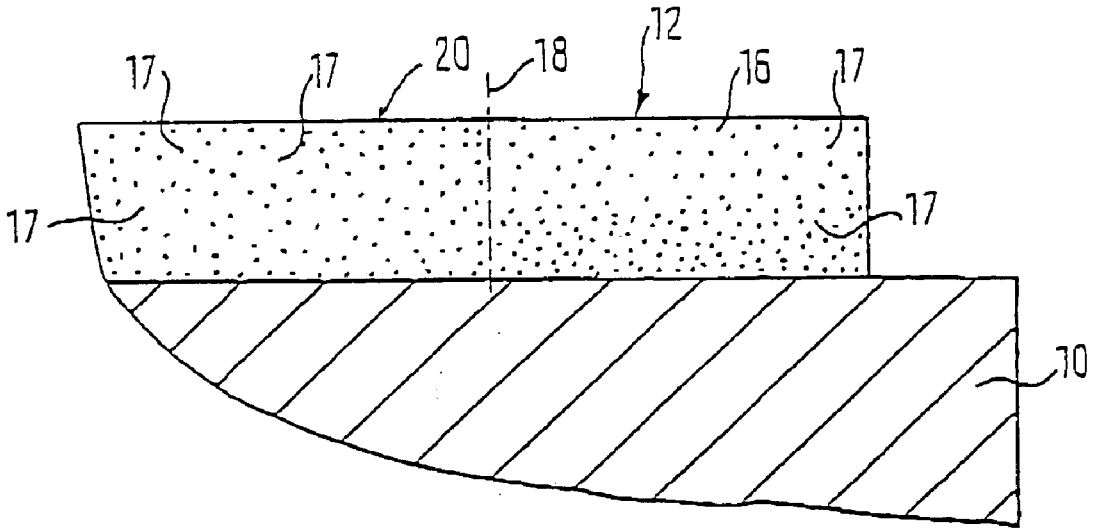
FIG. 1 shows a partial longitudinal section through a roll formed in accordance with the invention with an elastic covering layer.

FIG. 1 shows a part of a roll core 10 which is cut in the longitudinal direction, and which is made of, for example, steel or chilled cast iron and is provided at its outside with an elastic covering layer 12 likewise illustrated in a cut manner.

Figure 2:
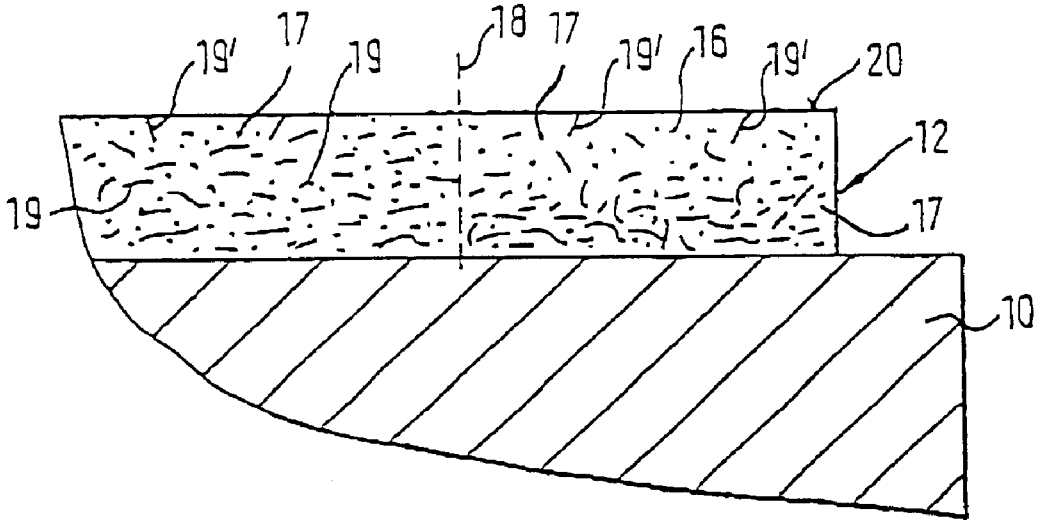
FIG. 2 shows another embodiment of a roll of the invention with an elastic covering layer.

The covering layer 12 includes an elastic matrix material 16 into which particle-like fillers 17, for example, in powder form are introduced. The particle-like fillers 17 may have diameters of less than 1 μm, with the diameter preferably being less than 800 nm, in particular less than 500 nm and advantageously even less than 200 nm. In addition to the powdery fillers 17, extremely thin fibers 19 are also embedded in an appropriate manner in the matrix material, as is shown in FIG. 2. For reasons of clarity, the fibers 19 are not illustrated in FIG. 1.

The fillers 17 can, as schematically illustrated in the left hand half of FIG. 1, be distributed substantially uniformly over the covering layer 12 or, as illustrated in the right hand half of FIG. 1 separated by a dotted line 18, be distributed within the covering layer 12 such that the concentration of the fillers 17 reduces radially outwardly.

The physical properties, for example, the coefficient of thermal expansion, thermal conductivity, elasticity, etc., of the covering layer 12 is dominated more by the fillers in the radially inner region than in the radially outer region due to such a distribution of the fillers. With an appropriate selection of the filler materials, the coefficient of thermal expansion can thus be matched to the coefficient of thermal expansion of the roll core 10 in the radially inner region of the covering layer 12 so that longitudinal stresses occurring in operation can be compensated by an unequal expansion of the roll core 10 and the covering layer 12.

The thermal conductivity can likewise be increased in the radially inner region of the covering layer 12 by the embedded fillers 17 so that excess heat occurring in particular in the region between the roll core 10 and the covering layer 12 can be led off quickly to the side.

An extremely smooth surface 20 of the covering layer 12 is ensured by the extremely low dimensions of the fillers 17. This smooth surface 20 is achieved in that this is first ground and subsequently polished after the forming of the covering layer 12. As a result of the extremely small dimensions of the fillers 17, the fillers 17 which lie at the surface 20 during grinding and polishing and thus form the surface 20 together with the matrix material 16 do not impair the smoothness of the surface 20 either. Surfaces can thus be produced with Ra values of less than 0.5 μm or even less than 0.2 μm, in extreme cases even of less than 0.1 μm.

In FIG. 2, the fibers 19 arranged in the matrix material 16 are illustrated which are formed in particular as carbon fibers. Whereas the fibers 19 are again arranged uniformly distributed within the covering layer 12 in the left hand half of FIG. 2, in the right hand half separated by the dotted line 18 a distribution of the fibers 19 is illustrated which, similar to the distribution of the powdery particles 17 in FIG. 1, reduces radially outwardly. The advantages already described with reference to FIG. 1 are achieved thereby. The powdery fillers 17 are schematically indicated between the fibers 19.

The formation of the fillers as fibers 19 has the advantage that depending on the length of the fibers 19 the heat arising in each case at the inside of the covering layer 12 can be quickly led off without interruption through the elastic matrix material 16. In addition, a higher stiffness of the covering layer 12 can be achieved by the fibers 19.

The fibers 19 have a diameter of less than 800 nm, in particular of less than 500 nm or even of less than 200 nm. An extremely smooth surface 20 of the covering layer 12 is achieved after the grinding and polishing due to this extremely thin formation of the fibers as already described with reference to FIG. 1. Since one of the ends of the fibers 19 as a rule extends toward the surface 20 of the covering layer 12 or projects out of this by a minimal amount, as can be seen in FIG. 2 by way of example at the fibers marked with 19', the smoothness of the surface 20 is determined by the diameter of the fibers 19'. Due to the extremely small diameters of the fibers 19 of less than 1 μm, an extremely smooth surface of the covering layer 12 is thus achieved after the grinding and polishing which lies in the range of the smoothness of the surface of a hard roll.

Figure 3:
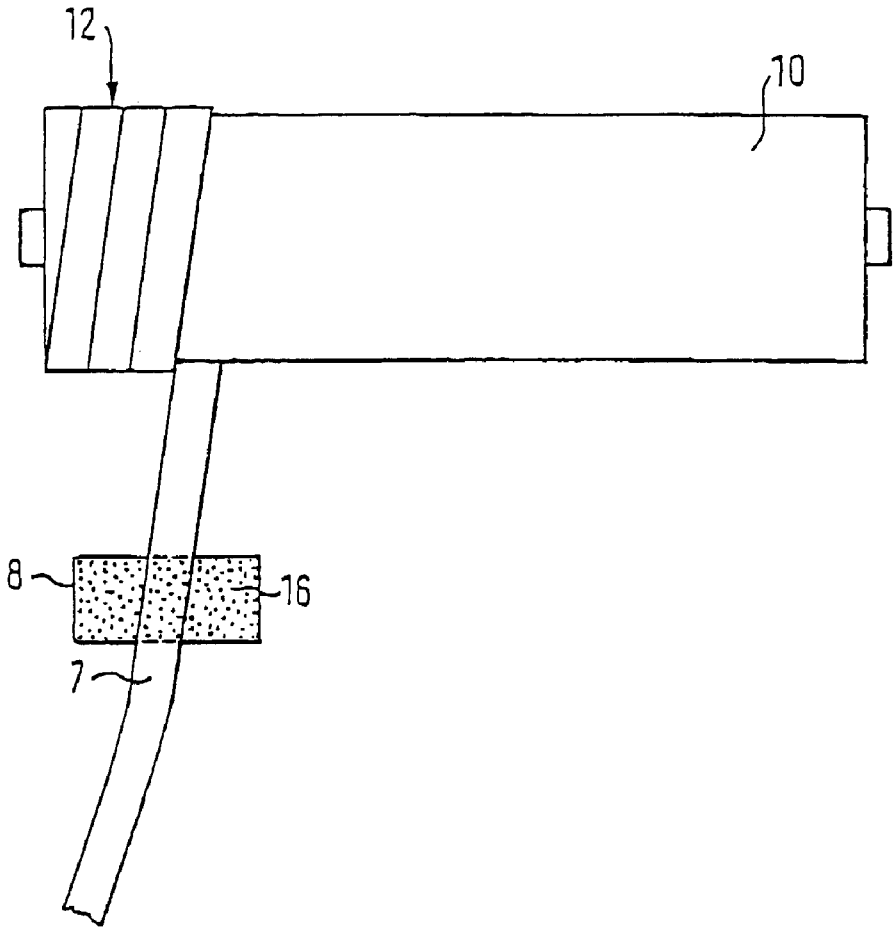
FIG. 3 shows a schematic illustration of a roll of the invention during its manufacture.

FIG. 3 shows the manufacture of a roll formed in accordance with the invention by winding. Generally, a roll of the invention can also be manufactured in different manufacturing methods, for example, injection, casting or other suitable methods.

In accordance with FIG. 3, a plurality of fibers combined to form a fiber bundle 7 are guided, in particular in the form of a fiber roving, through a schematically illustrated coating apparatus 8. The individual fibers are coated with a liquid matrix material 16 in the coating apparatus 8 so that the fibers are substantially completely embedded in the matrix material 16 The matrix material 16 can here be a plastic, in particular a resin/hardener combination. Additional fillers, for example in the form of the powdery fillers 17, can be provided in the matrix material 16 whose dimensions are throughout less than 1 μm.

The fiber bundle 7 surrounded in full by the matrix material 16 by the coating apparatus 8 is wound end to end or overlappingly on the roll core 10 so that this is completely covered with a fiber layer 7 coated with matrix material 16 over the whole length of the roll core 10 after one winding cycle.

This winding procedure can be repeated a plurality of times until a coating layer 12 with a sufficient thickness of 3 to 20 mm is produced. Subsequently, the covering layer 12 can be ground and polished to obtain an extremely smooth surface, with an extremely smooth surface of the covering layer 12 being obtained due to the extremely small dimensions of the fibers or of the additional fillers.

Figure 5:
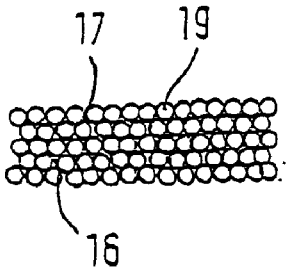
FIG. 5 shows fibers formed in accordance with the invention embedded in an elastic covering layer.
Figure 4:
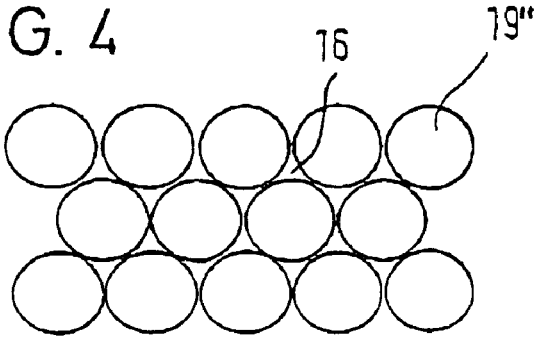
FIG. 4 shows a schematic cross-section through fibers of the prior art.

In the sectional illustration shown in FIGS. 4 and 5, the increased packing density of a covering layer of the invention (i.e., FIG. 5) with respect to a conventional covering layer (i.e., FIG. 4) can be seen, with only the fibers embedded into the matrix material being shown which, for example, are aligned substantially in the peripheral direction of the roll when a fiber fleece is used.

Whereas in FIG. 4 the cross-section through fibers 19" of conventional thickness is shown schematically, FIG. 5 shows a cross-section through fibers 19 with the reduced diameter of the invention. When comparing the conventional design shown in FIG. 4 to that of FIG. 5, it can be seen that less matrix material 16 is present between the fibers 19 in the covering layer of the invention than between the fibers 19" due to the reduced diameter and the increased packing density of the fibers 19 associated therewith. In addition, the likewise extremely small powdery fillers 17 are present in this matrix material 16 which effect a good thermal conductivity between the individual fibers. Since the thermal conductivity of the matrix material 16 is normally much lower than the thermal conductivity of the fiber material, the covering layer 12 of the invention thus has an improved overall thermal conductivity.

Reference Numeral List

7 fiber bundle
8 coating apparatus
10 roll core
12 covering layer
16 elastic matrix material
17 powdery fillers
dotted line
19, 19', 19" fibers
20 surface of the covering layer

What is claimed:

1. A roll for smoothing a web comprising:

a hard roll core;

an elastic covering layer arranged on an outside surface of the hard roll core;

the elastic covering layer comprising an elastic matrix material and fibers embedded in the elastic matrix material;

at least some of the fibers comprising a diameter which is less than 800 nm; and powdery fillers embedded in the elastic matrix materials, wherein a surface of the elastic covering layer has an extremely high smoothness, and wherein the extremely high smoothness is defined by an Ra value of less than around 0.6 μm.

2. The roll of claim 1, wherein the elastic covering layer comprises a thickness of between 3 mm and 20 mm.

3. The roll of claim 1, wherein at least some of the powdery fillers comprise an outer dimension which is less than 1 μm at least in one direction.

4. The roll of claim 1, wherein the web comprises a paper web.

5. The roll of claim 1, wherein the hard roll core comprises a metal.

6. The roll of claim 5, wherein the metal comprises one of steel and chilled cast iron.

7. The roll of claim 1, wherein the diameter is less than around 500 nm.

8. The roll of claim 7, wherein the diameter is less than around 200 nm.

9. The roll of claim 1, wherein at least some of the fibers comprise carbon fibers.

10. The roll of claim 1, wherein the fibers comprise a material that has a higher thermal conductivity than that of the elastic matrix material.

11. The roll of claim 1, wherein the fibers are uniformly distributed in the elastic matrix material.

12. The roll of claim 1, wherein the surface of the elastic covering layer has an Ra value of less than around 0.5 $\mu$m.

13. The roll of claim 12, the surface of the elastic covering layer has an Ra value of less than around 0.2 $\mu$m.

14. The roll of claim 13, the surface of the elastic covering layer has an Ra value of less than around 0.1 $\mu$m.

15. The roll of claim 1, wherein the roll comprises a length of between 3 meters and 12 meters.

16. The roll of claim 1, wherein the roll comprises a diameter of between 450 millimeters and 1500 millimeters.

17. The roll of claim 1, wherein the roll can withstand line forces of up to 600 N/mm and compressive stresses of up to 130 N/mm$^2$.

18. The roll of claim 1, wherein the roll is a smoothing web roll.

19. A roll for smoothing a web comprising:

a hard roll core;

an elastic covering layer arranged on an outside surface of the hard roll core;

the elastic covering layer comprising an elastic matrix material and fibers embedded in the elastic matrix material;

at least some of the fibers comprising a diameter which is less than 800 nm; and powdery fillers embedded in the elastic matrix material, wherein at least one outer dimension of the powdery fillers is smaller than around 1 $\mu$m, wherein a surface of the elastic covering layer has an extremely high smoothness, and wherein the extremely high smoothness is defined by an Ra value of less than around 0.6 $\mu$m.

20. The roll of claim 19, wherein at least one outer dimension of the powdery fillers is smaller than around 800 nm.

21. The roll of claim 20, wherein at least one outer dimension of the powdery fillers is smaller than around 500 nm.

22. The roll of claim 20, wherein the powdery fillers are smaller than 1 $\mu$m.

23. The roll of claim 22, wherein the powdery fillers are smaller than around 800 nm.

24. The roll of claim 23, wherein the powdery fillers are smaller than around 500 nm.

25. The roll of claim 24, wherein the powdery fillers are smaller than around 200 nm.

26. The roll of claim 9, wherein at least some of the powdery fillers comprise one of substantially round particles and spherical particles.

27. The roll of claim 19, wherein at least some of the powdery fillers comprise carbon.

28. The roll of claim 19, wherein the powdery fillers comprise a material that has a higher thermal conductivity than that of the elastic matrix material.

29. The roll of claim 19, wherein the powdery fillers are uniformly distributed in the elastic matrix material.

30. A method of making a roll for smoothing a web which includes a hard roll core, an elastic covering layer arranged on an outside surface of the hard roll core, the elastic covering layer comprising an elastic matrix material and fibers embedded in the elastic matrix material, and at least some of the fibers comprising a diameter which is less than 800 nm, the method comprising:

introducing the fibers into the elastic matrix material to form the elastic covering layer;

introducing powdery fillers into the elastic matrix material; and coupling the elastic covering layer with the hard roll core, wherein a surface of the elastic covering layer has an extremely high smoothness defined by an Ra value of less than around 0.6 $\mu$m.

31. The method of claim 30, wherein at least some of the powdery fillers comprise at least one outer dimension which is smaller than 1 $\mu$m.

32. The method of claim 30, further comprising forming the elastic covering layer with a thickness of between 3 mm and 20 mm.

33. The method of claim 30, further comprising forming the elastic covering layer on the hard roll core by one of an injection method, a casting method and a winding method.

34. The method of claim 30, further comprising forming the elastic covering layer on the hard roll core by one of an injection method, a casting method and a winding method.

35. The method of claim 30, further comprising applying the fibers and the elastic matrix material onto the hard roll core.

36. The method of claims 30, further comprising applying the fibers, the powdery fillers, and the elastic matrix material onto the hard roll core.

37. The method of claim 30, wherein the roll comprises a length of between 3 meters and 12 meters.

38. The method of claim 30, wherein the roll comprises a diameter of between 450 millimeters and 1500 millimeters.

39. The method of claim 30, wherein the roll can withstand line forces of up to 600 N/mm and compressive stresses of up to 130 N/mm$^2$.

40. A roll for smoothing a web comprising:

a hard roll core;

an elastic covering layer arranged on an outside surface of the hard roll core;

the elastic covering layer comprising an elastic matrix material and each of fibers and fillers embedded in the elastic matrix material;

at least some of the fibers comprising a diameter which is less than 800 nm; and at least some of the fillers comprising at least one outer dimension which is less than 1 $\mu$m, wherein a surface of the elastic covering layer has an Ra value of less than around 0.6 $\mu$m.

41. The roll of claim 40, wherein the roll comprises a length of between 3 meters and 12 meters.

42. The roll of claim 40, wherein the roll comprises a diameter of between 450 millimeters and 1500 millimeters.

43. The roll of claim 40, wherein the roll can withstand line forces of up to 600 N/mm and compressive stresses of up to 130 N/mm$^2$.

* * * * *